US007774941B2

(12) United States Patent
Johnson et al.

(10) Patent No.: US 7,774,941 B2
(45) Date of Patent: Aug. 17, 2010

(54) MULTI-TASKING UTILITY TOOL

(75) Inventors: Ronald L. Johnson, San Jose, CA (US); Russell D. Powers, Seatac, WA (US)

(73) Assignee: Wampum LLC, San Jose, CA (US)

( * ) Notice: Subject to any disclaimer, the term of this patent is extended or adjusted under 35 U.S.C. 154(b) by 0 days.

(21) Appl. No.: 10/184,303

(22) Filed: Jun. 26, 2002

(65) Prior Publication Data

US 2003/0028973 A1 Feb. 13, 2003

Related U.S. Application Data

(60) Provisional application No. 60/312,131, filed on Aug. 13, 2001.

(51) Int. Cl.
*B26B 11/00* (2006.01)
*B26B 1/08* (2006.01)

(52) U.S. Cl. ..... 30/162; 7/158; 7/160; 7/163; 30/158; 30/125

(58) Field of Classification Search ..... 7/160, 7/163, 158; 362/119; 30/162, 123, 125, 30/335, 336
See application file for complete search history.

(56) References Cited

U.S. PATENT DOCUMENTS

| | | | | |
|---|---|---|---|---|
| 1,368,944 A * | 2/1921 | Kurose | 7/160 |
| 1,444,155 A | 2/1923 | Jorgensen | |
| 2,980,996 A | 4/1961 | Beran | 30/157 |
| 3,657,812 A | 4/1972 | Lee | 30/162 |
| 3,660,895 A | 5/1972 | West | 30/162 |
| 4,068,375 A | 1/1978 | Rathbun et al. | 30/125 |
| 4,602,397 A | 7/1986 | Chao | 7/163 |
| 4,635,309 A | 1/1987 | Larsen | 7/158 |
| 4,744,146 A | 5/1988 | Schmidt | 30/162 |
| 4,792,883 A | 12/1988 | Ackerman et al. | 362/102 |
| 4,805,304 A | 2/1989 | Knoop | 30/162 |
| 4,854,045 A | 8/1989 | Schaub | 30/155 |
| 4,890,387 A | 1/1990 | Canino | 7/118 |
| 4,891,881 A | 1/1990 | Mills | 30/123 |
| 5,025,520 A * | 6/1991 | Watkins | 7/163 |
| 5,059,126 A | 10/1991 | Kimball | 434/308 |
| 5,174,028 A | 12/1992 | Seltzer, Jr. | 30/337 |
| 5,315,760 A | 5/1994 | Emerson | 30/123 |
| 5,342,379 A | 8/1994 | Volinsky | 606/167 |
| 5,396,820 A * | 3/1995 | Baker | 81/177.2 |
| 5,402,575 A * | 4/1995 | Maxcy | 30/123 |

(Continued)

FOREIGN PATENT DOCUMENTS

DE 196 23 167 A1 11/1996

(Continued)

*Primary Examiner*—D. S Meislin
(74) *Attorney, Agent, or Firm*—Haverstock & Owens LLP

(57) ABSTRACT

A multi-tasking utility tool comprising a body; a knife compartment coupled to the body, wherein the knife compartment contains a cutting tool, the cutting tool configured to extend out from the knife compartment; and a cartridge unit coupled to the body, the cartridge unit having a first writing instrument and a second writing instrument, wherein the first writing instrument and the second writing instrument are positioned opposite from one another, the cartridge unit rotatable between a first position and a second position, further wherein the first writing instrument is positioned within the body in the first position and extends away from the body in the second position.

21 Claims, 4 Drawing Sheets

U.S. PATENT DOCUMENTS

| | | | | |
|---|---|---|---|---|
| 5,450,775 | A * | 9/1995 | Kozak | 81/440 |
| 5,557,818 | A | 9/1996 | Leon | 7/160 |
| 5,711,194 | A | 1/1998 | Anderson et al. | 81/440 |
| 5,809,600 | A | 9/1998 | Cachot | 7/128 |
| 5,813,121 | A * | 9/1998 | Gringer | 30/162 |
| 5,887,306 | A | 3/1999 | Huang | 7/165 |
| 5,939,702 | A | 8/1999 | Knighton et al. | 235/472.03 |
| 5,945,656 | A | 8/1999 | Lemelson et al. | 235/462.01 |
| 5,955,719 | A | 9/1999 | Southworth et al. | 235/454 |
| 5,957,601 | A * | 9/1999 | Weiss | 401/18 |
| 6,050,490 | A | 4/2000 | Leichner et al. | 235/462.49 |
| 6,058,607 | A | 5/2000 | Gringer | 30/162 |
| 6,104,603 | A | 8/2000 | Wang | 361/679 |
| 6,119,944 | A | 9/2000 | Mulla et al. | 235/472.03 |
| 6,273,582 | B1 | 8/2001 | Taggart et al. | 362/119 |
| 6,276,014 | B1 | 8/2001 | Lee | 7/158 |
| 6,363,614 | B1 | 4/2002 | Umstead et al. | 30/144 |
| 6,438,849 | B1 | 8/2002 | Wonderley | |
| 6,446,871 | B1 | 9/2002 | Buckley et al. | 235/472.03 |
| 6,454,427 | B1 | 9/2002 | Chen | 362/119 |
| 6,467,114 | B1 * | 10/2002 | Sigl | 7/158 |
| 6,481,628 | B2 | 11/2002 | Liou et al. | 235/472.03 |
| 6,487,778 | B1 | 12/2002 | Gringer et al. | |
| 6,641,044 | B2 | 11/2003 | Plesko | 235/462.49 |
| 6,718,640 | B1 | 4/2004 | John | 30/162 |
| 6,752,317 | B2 | 6/2004 | Dymetman et al. | 235/462.45 |
| 6,868,571 | B1 | 3/2005 | Fischer et al. | 7/164 |
| 6,874,188 | B2 | 4/2005 | Johnson et al. | 7/158 |
| 6,966,113 | B2 | 11/2005 | Fossella | |
| 7,178,244 | B2 | 2/2007 | Fossella | |
| 7,395,600 | B2 | 7/2008 | Fossella | |
| 7,418,784 | B2 | 9/2008 | Fossella | |
| 2003/0106159 | A1 | 6/2003 | Ackeret et al. | 7/160 |
| 2004/0016058 | A1 | 1/2004 | Gardiner et al. | 7/119 |
| 2004/0141313 | A1 | 7/2004 | Elsener | 362/119 |
| 2005/0081302 | A1 | 4/2005 | Elsener | 7/118 |
| 2006/0030289 | A1 | 2/2006 | Liguori et al. | 455/344 |
| 2006/0212058 | A1 | 9/2006 | Djordjevic et al. | |

FOREIGN PATENT DOCUMENTS

| | | |
|---|---|---|
| GB | 2 349 841 | 11/2000 |
| JP | 5088385 | 7/1975 |
| JP | 56-106162 U | 8/1981 |
| JP | 57161965 | 10/1982 |
| JP | 59-59970 U | 4/1984 |
| JP | 61-124276 U | 8/1986 |
| JP | 63-63497 U | 4/1988 |
| JP | 3035634 U | 1/1997 |
| TW | 341539 | 10/1998 |

* cited by examiner

MULTI-TASKING UTILITY TOOL

RELATED APPLICATIONS

This patent application claims priority under 35 U.S.C. 119(e) of the U.S. Provisional Patent Application, Serial No. 60/312,131, filed Aug. 13, 2001, and entitled "THREE-IN-ONE UTILITY TOOL". The Provisional Patent Application, Serial No. 60/312,131 filed Aug. 13, 2001, and entitled "THREE-IN-ONE UTILITY TOOL" is also hereby incorporated by reference.

FIELD OF THE INVENTION

The present invention relates to the field of hand held tools. More specifically, the present invention relates to the field of a multi-tasking tool having a knife blade and a rotatable and/or replaceable cartridge having a plurality of instruments.

BACKGROUND OF THE INVENTION

In the existing world of tools many different types of cutting tools are available. One of these cutting tools is a box cutting tool or an Exacto knife. The knife portion in the box cutting knife is sufficiently sharp such that the knife will easily cut through material. Therefore, many carpenters and tool users mark where the material is to be cut before using the Exacto knife to cut the material. Also, when using such a knife to open boxes, a writing instrument is useful to input markings on the box regarding the contents of the box. Thus, the user must keep a pen or marker nearby when using a box cutting knife. Although box cutting knives are very popular, the knife blade is very sharp and therefore dangerous. Box cutting knives have a knife switch on the top of the body which slides between an extended and a retracted position. When the knife switch is in the retracted position, the knife itself is contained within the body of the tool. However, when the user wants to use the knife, he or she pushes the knife switch forward to the extended position, whereby the knife extends out a front slot. Box cutting knives do not have a safety mechanism which automatically causes the knife to retract within the body of the cutting tool when not in use. Thus, a user may easily cut herself if not paying attention to the knife blade.

SUMMARY OF THE INVENTION

In one aspect of the invention, a utility tool comprises a body having a first end and a second end. The first end and the second end are positioned on opposite ends of the body. A cutting tool is positioned within the body, wherein the cutting tool is configured to extend out from the first end. A cartridge unit is coupled to the body, wherein the cartridge unit includes a first tool. The cartridge unit is moveable between a first position and a second position, wherein the first tool extends out from the second end when the housing member is in the first position. The utility tool further includes a knife switch that is coupled to the cutting tool, wherein the knife switch allows the cutting tool to slidably extend out and retract within the utility tool. The cartridge unit further comprises a second tool extending on an end of the cartridge unit opposite of the first instrument. The second tool extends out from the second end when the housing member is in the extended position. The first tool is a writing instrument and the second tool is a marking instrument. The utility tool further comprises a container that is integrally formed within the utility tool for housing one of the ends of the cartridge unit positioned within the utility tool. The utility tool includes a track that is positioned along the utility tool, wherein the cartridge unit is coupled to the track and moveable along the track.

In another aspect of the invention, a utility tool comprises a body and a first housing coupled to the body. The first housing contains a cutting tool, whereby the cutting tool is configured to extend out from the first housing. A second housing is coupled to the body, in which the second housing has a first end and a second end. The first end and the second end are positioned opposite from one another. The second housing is configured to rotate between a first position and a second position. The first end is positioned within the body in the first position. The first end is positioned away from the body in the second position. The utility tool further comprises a knife switch that is coupled to the cutting tool. The knife switch retracts the cutting tool within the utility tool. The cartridge unit further comprises a first tool extending from the first end and a second tool extending from the second end. The first tool is preferably a writing instrument and the second tool is preferably a highlighting marker. The utility tool further comprises a container integrally formed within the utility tool, whereby the container is for housing one of the ends of the second housing positioned within the utility tool. The utility tool has a track integrally formed within and positioned along the utility tool, wherein the second housing is coupled to the track and moveable along the track.

In another aspect, a cutting tool has a first end and a second end positioned opposite from one another. The cutting tool comprises a cartridge unit that is positionable within the cutting tool. The cartridge unit has a third end and a fourth end, wherein the third end and the fourth end are configured opposite from one another. The cartridge unit is rotatable about an axis, wherein the third end is positioned within the cutting tool when the fourth end is proximal to the first end. The fourth end is positioned within the cutting tool when the third end is proximal to the first end. The cutting tool further comprises a knife configured to extend out from the second end of the cutting tool. The cutting tool further comprises a knife switch that is coupled to the knife, wherein the knife switch retracts the knife within the cutting tool. The cartridge unit further comprises a first writing instrument which extends from the third end and a second writing instrument which extends from the fourth end. The first writing instrument is preferably a pen, and the second writing instrument is preferably a marker. The cutting tool further comprises a container integrally formed within the cutting tool, whereby the container is for housing the end of the cartridge unit positioned within the cutting tool. The cutting tool has a track integrally formed within and positioned along the cutting tool, wherein the cartridge unit is coupled to the track and moveable along the track.

Yet in another aspect, a multi-tasking utility tool comprises a body as well as a knife compartment that is coupled to the body. The knife compartment contains a cutting tool. The cutting tool is configured to extend out from the knife compartment. A cartridge unit is coupled to the body. The cartridge unit has a first writing instrument and a second writing instrument. The first writing instrument and the second writing instrument are positioned opposite from one another. The cartridge unit is rotatable between a first position and a second position. The first writing instrument is positioned within the body in the first position and extends away from the body in the second position. The utility tool further comprises a knife switch which is coupled to the cutting tool, wherein the knife switch retracts the cutting tool within the knife compartment. The first writing instrument is a pen and the second writing instrument is a highlighting marker. The utility tool further comprises a container that is integrally formed within the body. The container is for housing one of the ends of the cartridge unit when positioned within the body. The utility tool having a track integrally formed within and positioned along the utility tool, wherein the cartridge unit is coupled to the track and moveable along the track.

Other features and advantages of the present invention will become apparent after reviewing the detailed description of the preferred embodiments set forth below.

DETAILED DESCRIPTION OF THE PREFERRED EMBODIMENT

Reference will now be made in detail to the preferred and alternative embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which is included within the spirit and scope of the invention as defined by the appended claims. Furthermore, in the following detailed description of the present invention, numerous specific details are set forth in order to provide a thorough understanding of the present invention. However, it should be noted that the present invention is able to be practiced without these specific details. In other instances, well known methods, procedures and components have not been described in detail as not to unnecessarily obscure aspects of the present invention.

Figure 1:
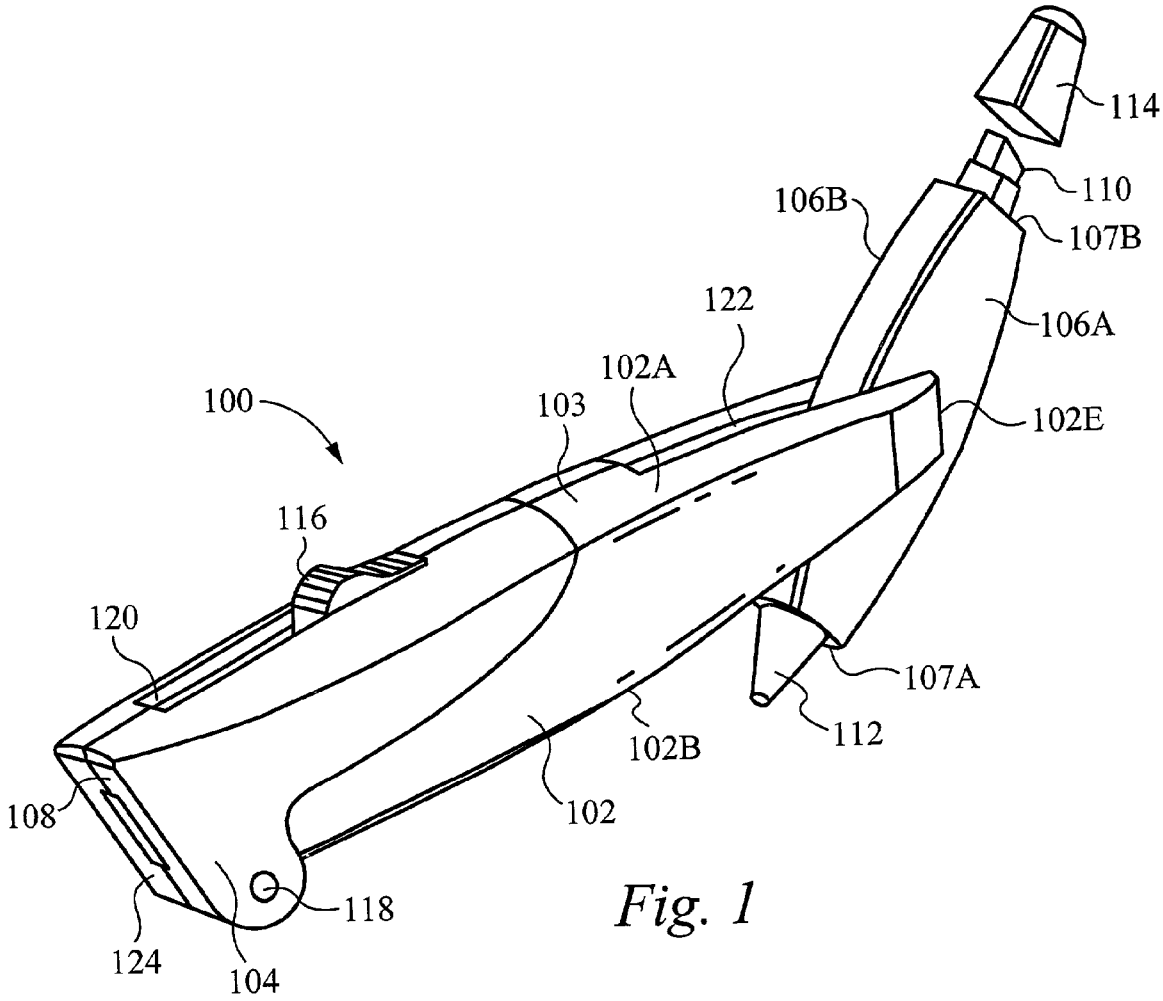
FIG. 1 illustrates a perspective view of the preferred embodiment of the utility tool in accordance with the present invention.
Figure 2:
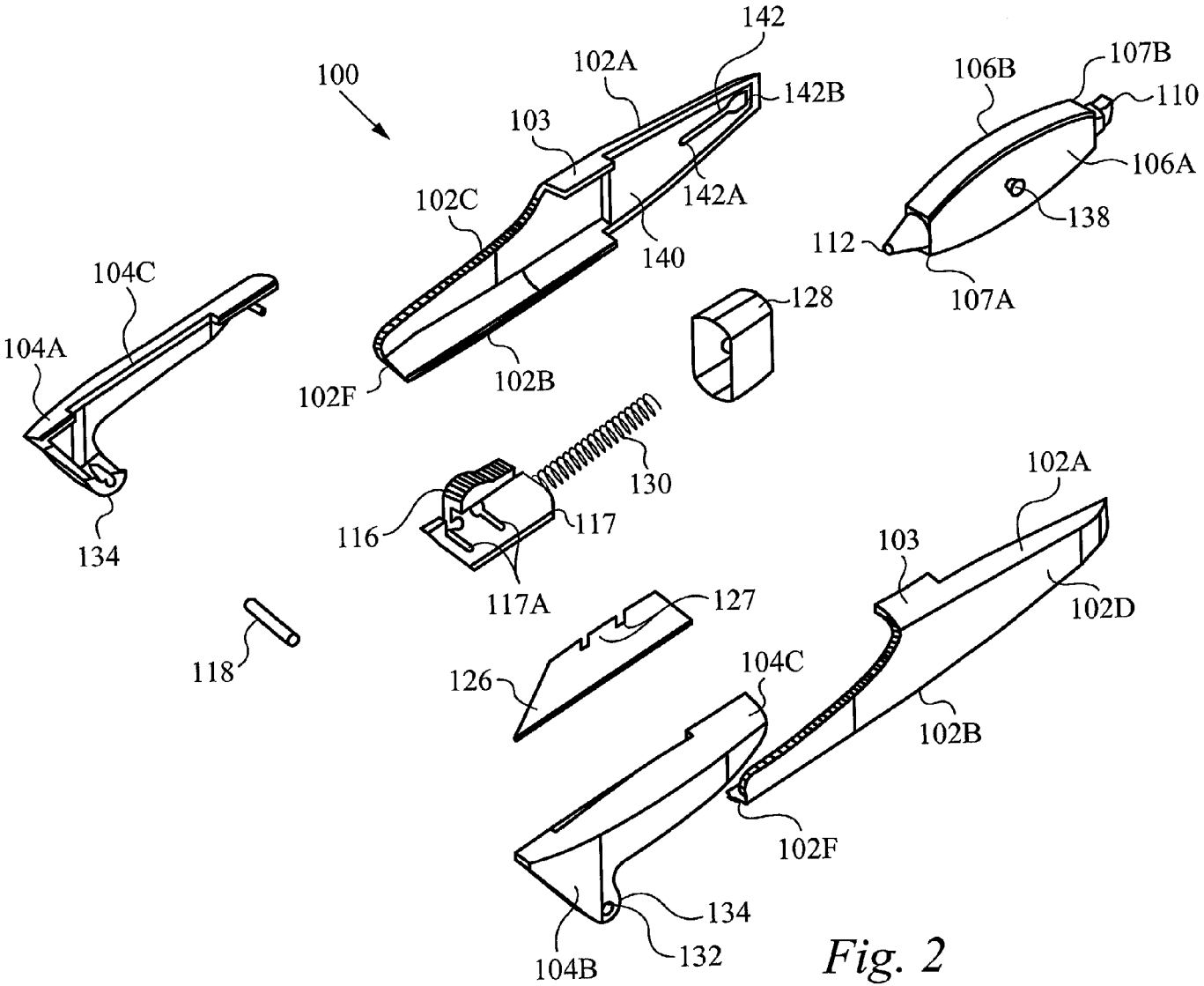
FIG. 2 illustrates an exploded view of the preferred embodiment of the utility tool in accordance with the present invention.
Figure 3:
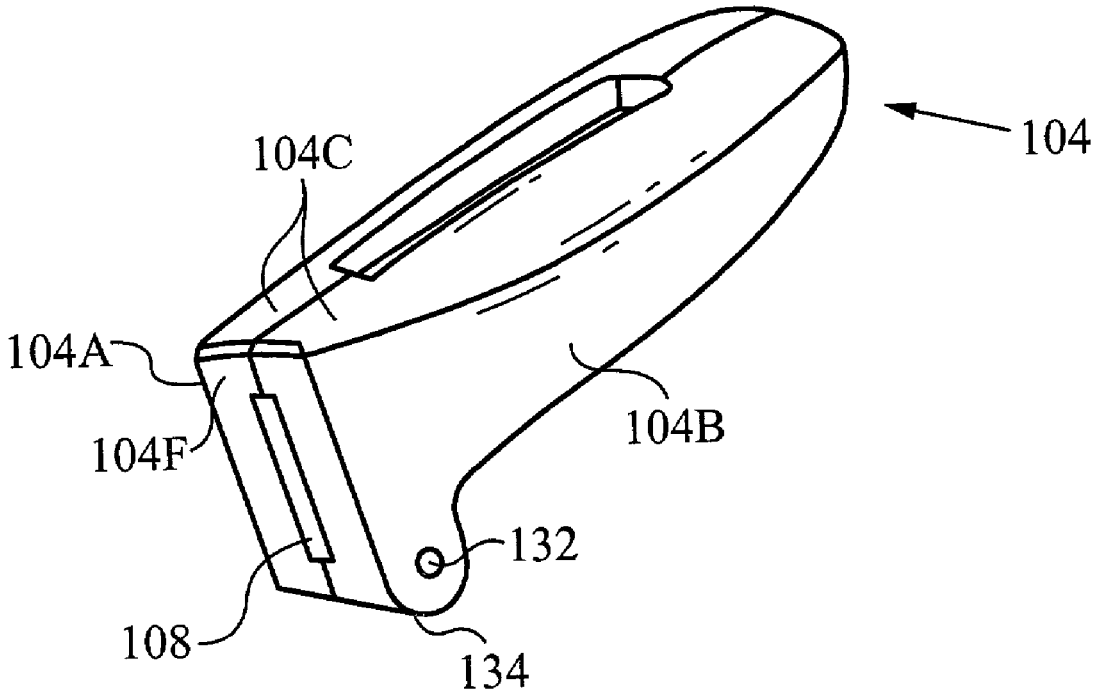
FIG. 3 illustrates a perspective view of the preferred embodiment of the knife compartment in accordance with the present invention.
Figure 4A:
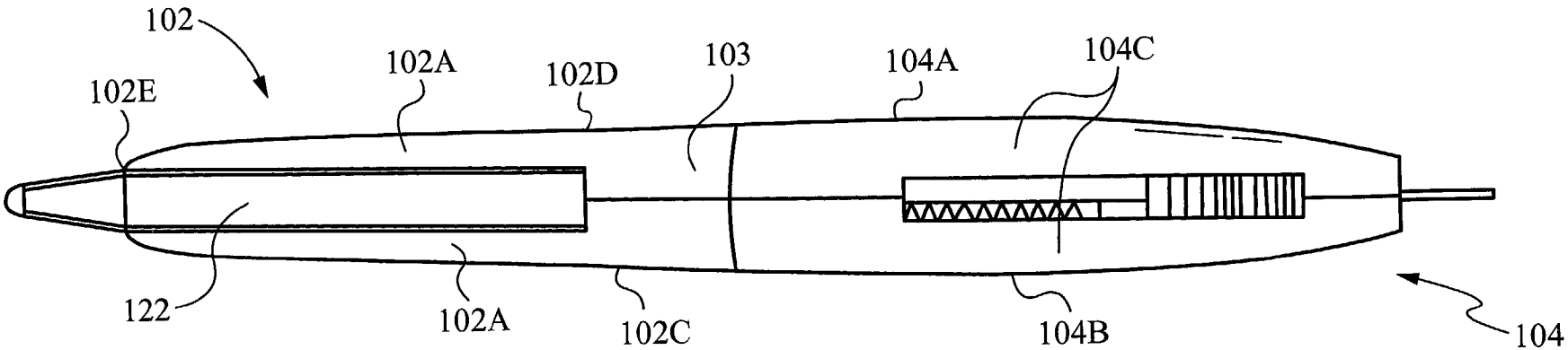
FIG. 4A illustrates a top view of the preferred embodiment of the utility tool in accordance with the present invention.
Figure 4B:
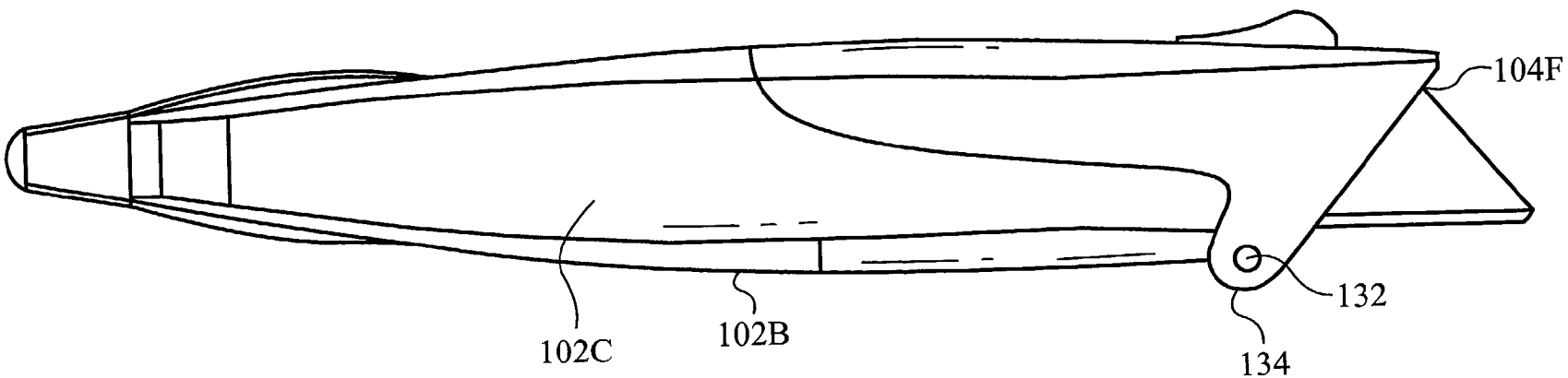
FIG. 4B illustrates a side view of the preferred embodiment of the utility tool in accordance with the present invention.

FIG. 1 illustrates a perspective view of the preferred embodiment of the utility tool 100 in accordance with the present invention. FIG. 2 illustrates an exploded view of the preferred embodiment of the utility tool 100 in accordance with the present invention. FIG. 3 illustrates a perspective view of the preferred embodiment of the knife compartment in accordance with the present invention. FIG. 4A illustrates a top view of the preferred embodiment of the utility tool in accordance with the present invention. FIG. 4B illustrates a side view of the preferred embodiment of the utility tool in accordance with the present invention.

The preferred embodiment of the utility tool 100, generally as shown in FIG. 1, comprises a body 102, a knife compartment 104, a rotatable cartridge unit 106 having a highlighting marker 110 and a pen 112. Preferably, the highlighting marker 110 and/or the pen 112 are covered by the cap 114. In addition, the utility tool 100, as shown in FIG. 2, preferably contains a knife 126, a pin 118, an interior cap 128, a knife switch 116 with an attached spring feature 130, a platform 117 and knife blade 126.

As shown in FIGS. 4A and 4B, the body 102 or housing of the tool 100 has a top surface 102A, a bottom surface 102B, a right side 102C, a left side 102D, a rear 102E and a front 102F (FIG. 2). Although, the body 102 is preferably made of these two pieces, it should be understood alternatively that the body 102 is made of any appropriate number of pieces, including only one piece. As shown in FIGS. 2 and 4A, the body 102 preferably includes a notch 103 on the top surface 102A of each side which is located midway between the end 102E and the front 102F of the body 102. FIG. 1 shows that the body 102 also includes a cartridge slot 122 which is defined as the space between the end 102E and notch 103. The cartridge slot 122 is also defined as the space between the top surface 102A and the bottom surface 102B, as discussed in more detail below.

The knife compartment 104, as shown in FIGS. 2 and 3, comprises a right side 104A and a left side 104B, wherein the left side 104B and the right side 104A both have a corresponding top surface 104C. The knife compartment 104 includes a front face 104F which is preferably positioned opposite of the end 102F of the body 102. Although the knife compartment 104 is discussed as being separate from the body 102, alternatively, the body 102 and the knife compartment 104 are one integral component of the tool 100. The knife compartment 104 is preferably coupled to the body 102, such that the right side 104A of the knife compartment 104 is configured to be positioned adjacent to the right side 102D of the body 102. Similarly, the left side 104B of the knife compartment 104 is configured to be positioned adjacent to the left side 102D of the body 102.

The knife compartment 104 includes a rounded portion 134 and an aperture 132 in the right side 104A and the left side 104B of the knife compartment 104. The rounded portion 134 is preferably configured to be located near the bottom surface 102B of the body 102. The right side 104A and the left side 104B of the knife compartment 104 are preferably coupled together by a pin 118 which fits into the apertures 132 in the rounded portion 134 of the knife compartment 104. The knife compartment 104, when coupled to the body 102, forms the tool 100. The rounded portion 134 of the knife compartment 104 is positioned underneath the front surface 102F of the body 102 when the knife compartment 104 is coupled to the body 102.

The knife compartment 104 preferably couples to the body 102 by a friction fit, wherein the distance between the inside walls of the knife compartment 104 is slightly smaller than the distance between the right side 102C and left side 102D of the body 102. In the preferred embodiment, the pin 118 maintains the friction fit between the knife compartment 104 and body 102 by holding the right side 104A and the left side 104B of the knife compartment 104 together. Alternatively, other means for holding the right side 104A and the left side 104B together are used. Alternatively, the knife compartment 104 is coupled to the body 102 by screws, snap fit or other means that allows the user to open the knife compartment 104 to remove or exchange knife blades 126. Preferably, the knife compartment 104 rotates about the pin 118 when moving between the open and closed position.

The front face 104F of the knife compartment 104, shown in FIG. 3, extends from the top surface 104C downward to the rounded portion 134. A knife slot 108 runs along the front face 104F of the knife compartment 104. The knife switch 116 (FIG. 1) is configured to allow the knife or knife blade 126 to be retractable, such that the knife 126 slides between a retracted position and an extended position. The knife 126 is preferably within the knife compartment 104 when in the retracted position, as shown in FIG. 1. Likewise, the knife 126 penetrates out of the knife slot 108 when the knife 126 is in the extended position, as shown in FIGS. 4A and 4B.

In the preferred embodiment, the top surface 104C of the knife compartment 104 has an indented rectangular groove 120 for housing the knife switch 116, as shown in FIG. 1. It is preferred that the knife switch 116 and attached support platform 117 is coupled to a spring feature 130 which attaches to the body 102, whereby the spring feature 130 urges the knife switch 116 to the retracted position. Thus, the knife switch 116 prevents the knife 126 from unintentionally being left in the extended position. It is also preferred that the knife 126 is easily replaceable from the knife compartment 104. As described above, the knife compartment 104 preferably rotates about the pin 118 between the closed and open position. When the knife compartment 104 is in the open position, both the knife blade 126 and the knife switch 116 are exposed. As shown in FIG. 2, the knife switch 116 is coupled to a support platform 117 which engages the knife blade 126. Specifically, the support platform 117 includes two engaging pins 117A which are configured to engage the knife blade 126, in which the pins 117A fit within the knife blade notches 127. When the knife compartment 104 is in the open position and the knife switch 116 as well as the knife blade 126 is exposed, the user removes the worn out knife blade 126 by disengaging the knife blade notches 127 from the engaging pins 117A. The user then inserts a new knife blade 126 by coupling the engaging pins 117A within the knife blade notches 127. Alternatively, the knife switch 116 with the knife blade 126, attached as one unit, may be completely removed and replaced with another unit containing a new knife switch 116 and knife blade 126. Thus, the knife 126 would be easily changeable with a minimum amount of contact with the knife 126 itself.

As described above, the body 102 has a cartridge slot 122 which is defined as the space from the top surface 102A to the bottom surface 102B of the body 102. The slot 122 preferably has a rectangular shape and passes from the end 102E midway to the notch 103. Preferably, both of the inside walls 140 of the body 102 include a track 142 for housing a knob or knob member 138 extending from the cartridge unit 106, as will be discussed in more detail below. Alternatively, only one of the inside walls 140 of the body 102 includes a track 142 for housing the knob 138. The distance of the cartridge slot 122 from the end 102E to the notch 103 is preferably less than the distance between the ends 107A and 107B of the cartridge unit 106. The track 142 allows the cartridge unit 106 to traverse along the body 102 from an inward or first position which is represented as the narrow portion 142A of the track 142, to an outward or second position which is represented as the wide portion 142B of the track 142, as will be discussed below.

The cartridge unit 106 or housing shown in FIGS. 1 and 2 has a substantially rectangular shape. The cartridge unit 106 has a left side 106A and a right side 106B as well as two ends, shown as 107A and 107B. The ends 107A and 107B are preferably configured to be positioned to face away from one another, in which each end 107A, 107B of the cartridge unit 106 has a tool. Preferably, as shown in FIGS. 1 and 2, the tool is a marking instrument, such as a pen 112 and a highlighter 110, where the pen 112 extends out from the end 107A and the highlighter 110 extends out from the end 107B. Thus, it is preferred that the pen 112 extends out from the cartridge unit 106 in a direction opposite from the marker 110. Alternatively, the cartridge unit 106 is configured to have other instruments, such as a retractable tape measure, flashlight, compass, level, bar code scanner or other accessory, extending out from the ends 107A and 107B.

As shown in FIG. 2, the cartridge unit 106 preferably also has a knob 138 which extends out perpendicularly from the center of both the left side 106A and the right side 106B of the cartridge unit 106. Alternatively, the knob 138 is configured to extend out from only one side of the cartridge unit 106 or extend out from a position other than the center of the cartridge unit 106. The knob 138 allows the cartridge unit 106 to rotate about an axis extending through the knob 138.

It is preferred that the cartridge unit 106 is positioned within the cartridge slot 122. The knob 138 extending from each side of the cartridge unit 106 fits in the track 142 located integrally within the cartridge slot 122. As described above, the cartridge unit 106 is rotatable about the knob 138. Thus, a user rotates the cartridge unit 106 such that the desired end of the cartridge unit 106 faces out from the end 102E of the tool 100. When the desired end of the cartridge unit 106 is in the exposed position or faces out from the end 102E of the tool 100, the end opposite of the desired end is preferably contained within the body 102. For example, if a user desires to use the end 107A having the pen 112, she will rotate the cartridge unit 106 such that the end 107A faces out the rear 102E of the tool 100. As discussed above, the ends 107A and 107B of the cartridge unit 106 are positioned opposite of one another. Thus, the end 107B of the cartridge unit 106 having the highlighting marker 110 is preferably contained within the body 102 of the tool 100 when the end 107A is facing out from the rear 102E of the tool 100. The tool 100 preferably includes an interior cap 128 within the body 102 for providing a cover for and storing the end of the cartridge unit 106 that is not in the exposed position. Thus, in the example, the highlighting marker 110 would be contained within the interior cap 128.

The cartridge unit 106 is preferably removable, such that replacement cartridges are useable with the tool 100. In the preferred embodiment, the cartridge unit 106 is removed from the body 102 by moving the knob member 138 to the wide portion 142B of the track 142. Once the knob member 138 is positioned at the wide portion 142B, the user slightly twists or bends the cartridge unit 106 such that the one or more knob members 138 is no longer within the wide portion 142B. Once the knob member 138 is no longer within the wide portion 142B of the track 142, the user can easily remove the cartridge unit 106 from the body 102. Similarly, to insert a cartridge unit 106, the user slightly twists or bends the cartridge unit 106 until the one or more knob members 138 are positioned within the wide portion 142B. Alternatively, the cartridge unit 106 is inserted or removed from the body 102 by applying a force on the inside walls 140 of the body 102 such that the walls 140 slightly move away from each other. Causing the walls 140 to move away from each other allows the knob member 138 enough clearance to be inserted into or removed from the wide portion 142B of the track 142.

In the preferred embodiment of the present invention, to assemble the tool 100, the left side 102D and the right side 102C of the body 102 are snapped together by a snap tight fit. Alternatively, the sides 102C and 102D of the body 102 are assembled together by other means, such as adhesive, screw, or other equivalent. The interior cap 128 is placed between the sides 102C and 102D of the body 102 and held within the body 102 when the sides are snapped together. The cartridge unit 106 is coupled to the body 102, by inserting the knob 138 into the wide portion 142B of the track 142 located within the inside walls 140 of the cartridge slot 122. The knife compartment 104 is coupled to the body 102 by a snap fit, such that the rounded portion 134 of the knife compartment 104 is positioned substantially near to the front end 102F of the body.

Alternatively, the knife compartment 104 couples to the body 102 by other means, such as adhesive, screw, or other equivalent.

The knife compartment 104 is assembled by coupling the right side 104A and the left side 104B together by a snap fit. Preferably, the right side 104A and the left side 104B of the knife compartment 104 are held together by the cover pin 118 which fits within the aperture 132 that extends through each side of the knife compartment 104. Alternatively, the knife compartment 104 is assembled together by other means, such as adhesive, screw, or other equivalent. Also, the knife switch 116 is placed within the knife compartment 104, such that the grooved portion of the knife switch 116 protrudes out from the switch groove 120. As described above, the knife switch 116 is coupled to a platform 117 which includes the two engaging members 117A. The engaging members 117A are preferably coupled to the notches 127 of the knife blade 126. Thus, when the knife switch 116 moves to the extended position, the knife blade 126 is exposed through the knife slot 108. On the other hand, when the knife switch 116 moves to the retracted position, the knife blade 126 is within the knife compartment 104. The platform 117 couples to the spring 130 which attaches to a stationary point within the tool 100. The spring 130 biases the knife switch 116 to the retracted position within the knife compartment 104 of the tool 100 and prevents the knife blade 126 from being unintentionally left in the extended position.

To use the knife portion of the tool 100, a user simply presses the knife switch 116 toward the front end 104F of the knife compartment 104. The knife switch 116 allows the knife 126 to slidably move from the retracted position to the extended position, because the knife 126 is coupled to the platform. The knife blade 126 preferably stays in the extended position as long as pressure is applied by the user. Alternatively, a switch or locking mechanism may be used to lock the knife 126 in the extended position. As stated above, the knife switch 116 biases the knife 126 toward the retracted position, to prevent the knife 126 from being unintentionally left in the extended position.

A user also uses the cartridge unit 106 in the tool 100 to mark items as the user desires. As stated above, it is preferred that the cartridge unit 106 has two ends, 107A and 107B, each having a different tool, respectively a pen 112 and a highlighter marker 110. If the user wants to use the pen 112, she preferably pulls the cartridge unit 106 out along the track 142 toward the end 102E. As stated above, it is preferred that the length of the slot 122 is less than the distance between the ends 107A and 107B of the cartridge unit 106. Thus, once the cartridge unit 106 is substantially near or in the outer portion 142B of the track 142, there is enough distance to allow the cartridge unit 106 to rotate. The ability for the cartridge unit 106 to rotate allows the end 107A of the cartridge unit 106 to face out from the end 102E of the tool 100. When the end 107A of the cartridge unit 106 faces out the rear of the tool 100, the user preferably pushes the cartridge unit 106 along the track 142 away from the end 102E of the body 102, until the end 107B is contained within the body 102. Thus, the cartridge unit is locked, and the end 107B of the cartridge unit 106 having the highlighting marker 110 will be preferably contained within the body 102 when the end 107A is facing out the rear 102E of the tool 100. As stated above, the tool 100 preferably includes an interior cap 128 within the body 102 for storing the end 107 of the cartridge unit 106 that is not in the exposed position. Thus, in the preferred example, the highlight marker 110 would be contained within the interior cap 128.

Similarly, if the user prefers to use the highlighter marker 110, she preferably pulls the cartridge unit 106 out along the track 142 toward the end 102E such that the cartridge unit 106 has enough clearance within the slot 122 to rotate. At this point, the knob 138 of the cartridge unit 106 is substantially near or in the outer portion 142B of the track 142. The user then rotates the cartridge unit 106 such that the end 107B having the highlighting marker 110 faces out from the end 102E of the tool 100. The user then preferably pushes the cartridge unit 106 along the track 142 away from the end 102E of the body 102, until the end 107A is contained within the body 102. Thus, the cartridge unit 106 is locked, and the end 107A of the cartridge unit 106 having the pen 112 will be preferably contained within the body 102 of the tool 100 when end 107B is facing out the rear 102E of the tool 100. As noted above, the cartridge unit 106 alternatively has one or more of an array of tools which extend out from ends 107A and 107B, such as a retractable tape measure, flashlight, compass, level or other accessory. In addition, it is preferred that the tool 100 of the present invention be made of a soft elastomeric overmolding material. Alternatively, the tool 100 is made of any rigid material, such as hard plastic, metal, stainless steel, or other equivalent.

The present invention has been described in terms of specific embodiments incorporating details to facilitate the understanding of the principles of construction and operation of the invention. Such reference herein to specific embodiments and details thereof is not intended to limit the scope of the claims appended hereto. It will be apparent to those skilled in the art that modifications may be made in the embodiment chosen for illustration without departing from the spirit and scope of the invention.

What is claimed is:

1. A utility tool comprising:

a. a body;

b. a first housing coupled to the body, wherein the first housing comprises a cutting tool in a retracted position, wherein the cutting tool is configured to slidably extend out from the first housing into an extended position;

c. a pin for coupling the first housing to the body, wherein the first housing is rotatable about the pin, further wherein the cutting tool is exposed when the first housing is rotated into an open position;

d. a spring mechanism coupled to the cutting tool for biasing the cutting tool in the retracted position, wherein the cutting tool is only placed into the extended position when pressure is applied; and e. a second housing coupled to the body, the second housing having a first end and a second end, wherein the first end and the second end are positioned opposite from one another, the second housing configured to rotate between a first position and a second position while remaining coupled to the body, further wherein the first end is positioned within the body in the first position and the first end is positioned away from the body in the second position, the second housing further comprising a first tool extending from the first end and a second tool extending from the second end.

2. The utility tool according to claim 1 further comprising a knife switch coupled to the cutting tool, wherein the knife switch allows the cutting tool to slidably move between an extended position and a retracted position.

3. The utility tool according to claim 1 wherein the first tool is a writing instrument.

4. The utility tool according to claim 1 wherein the second tool is a measuring instrument.

5. The utility tool according to claim 4 wherein the measuring instrument is one of the group consisting of: a retractable tape measure, level, compass and bar code scanner.

6. The utility tool according to claim 1 further comprising a container integrally formed within the utility tool, the container for housing a selective one of the first tool and the second tool.

7. The utility tool according to claim 1 wherein the body includes an integrally positioned track within which the cartridge unit is moveable.

8. The utility tool according to claim 1 wherein the second tool is an illuminating instrument.

9. A utility tool comprising:

a. a body;

b. a first housing coupled to the body, wherein the first housing comprises a cutting tool in a retracted position, wherein the cutting tool is configured to slidably extend out from the first housing into an extended position;

c. a pin for coupling the first housing to the body, wherein the first housing is rotatable about the pin, further wherein the cutting tool is exposed when the first housing is rotated into an open position;

d. a spring mechanism coupled to the cutting tool for biasing the cutting tool in the retracted position, wherein the cutting tool is only placed into the extended position when pressure is applied; and e. a second housing coupled to the body, the second housing having a first side and a second side, wherein the first side is coupled to the second side, further the second housing having a first end and a second end, wherein the first end and the second end are positioned opposite from one another, the second housing configured to rotate between a first position and a second position while remaining coupled to the body, further wherein the first end is positioned within the body in the first position and the first end is positioned away from the body in the second position, the second housing further comprising a first tool extending from the first end and a second tool extending from the second end, further wherein the second housing is bendably removable, wherein the body includes an integrally positioned unexposed track within which the second housing is moveable.

10. The utility tool according to claim 9 further comprising a knife switch coupled to the cutting tool, wherein the knife switch automatically retracts the cutting tool within the utility tool when not in use.

11. The utility tool according to claim 9 wherein the first tool is a writing instrument.

12. The utility tool according to claim 9 wherein the second tool is a measuring device.

13. The utility tool according to claim 12 wherein the measuring instrument is one of the group consisting of: a retractable tape measure, level, compass and bar code scanner.

14. The utility tool according to claim 9 wherein the second tool is an illuminating device.

15. The utility tool according to claim 9 further comprising a container integrally formed within the utility tool, the container for housing a selective one of the ends of the second housing positioned within the utility tool.

16. A utility tool comprising:

a. a body having a first end and a second end, wherein the first end and the second end are positioned on opposite ends of the body;

b. a cutting tool positioned within the body, wherein the cutting tool is configured to slidably extend out from the first end;

c. a knife switch coupled to the cutting tool, wherein the knife switch allows the cutting tool to slidably move between an extended position and a retracted position;

d. a spring mechanism coupled to the knife switch for biasing the cutting tool to the retracted position;

e. a fully rotatable cartridge unit removably coupled to the body, the body comprising an integrally positioned track within which the cartridge unit is moveable, wherein the cartridge unit is positioned within the body by positioning one or more knob members of the cartridge unit within the track, wherein the cartridge unit includes a first tool and a second tool, and further wherein the cartridge unit is moveable between a first position and a second position while remaining coupled to the body, wherein the first tool extends out from the second end when the cartridge unit is in the first position and the second tool extends out from the second end when the cartridge unit is in the second position, and further wherein the fully rotatable cartridge unit is bendably removable from the body by moving the one or more knob member to a wide portion of the track and bending the cartridge unit such that the knob member is no longer within the wide portion of the track; and f. a container integrally formed within the utility tool, the container for housing a selective one of the first tool and the second tool.

17. The utility tool according to claim 16 wherein the first tool comprises a writing instrument.

18. The utility tool according to claim 17 wherein the writing instrument is a highlighting marker.

19. The utility tool according to claim 17 wherein the writing instrument is a pen.

20. The utility tool according to claim 16 wherein the second tool comprises a measuring instrument.

21. The utility tool according to claim 20 wherein the measuring instrument is one of the group consisting of: a retractable tape measure, level, compass and bar code scanner.

* * * * *